US010966479B2

(12) United States Patent
Browd et al.

(10) Patent No.: US 10,966,479 B2
(45) Date of Patent: Apr. 6, 2021

(54) PROTECTIVE HELMETS WITH NON-LINEARLY DEFORMING ELEMENTS

(71) Applicant: University of Washington through its Center for Commercialization, Seattle, WA (US)

(72) Inventors: Samuel R Browd, Seattle, WA (US); Jonathan D Posner, Seattle, WA (US); Per G Reinhall, Seattle, WA (US); David L Marver, Seattle, WA (US); John T Dardis, II, Seattle, WA (US)

(73) Assignee: UNIVERSITY OF WASHINGTON THROUGH ITS CENTER FOR COMMERCIALIZATION, Seattle, WA (US)

( * ) Notice: Subject to any disclaimer, the term of this patent is extended or adjusted under 35 U.S.C. 154(b) by 232 days.

(21) Appl. No.: 15/034,006

(22) PCT Filed: Nov. 5, 2014

(86) PCT No.: PCT/US2014/064173
§ 371 (c)(1),
(2) Date: May 3, 2016

(87) PCT Pub. No.: WO2015/069800
PCT Pub. Date: May 14, 2015

(65) Prior Publication Data

US 2016/0255900 A1 Sep. 8, 2016

Related U.S. Application Data

(60) Provisional application No. 61/900,212, filed on Nov. 5, 2013, provisional application No. 61/923,495, filed
(Continued)

(51) Int. Cl.
*A42B 3/14* (2006.01)
*A42B 3/06* (2006.01)
(Continued)

(52) U.S. Cl.
CPC ..... *A42B 3/14* (2013.01); *A42B 3/046* (2013.01); *A42B 3/064* (2013.01); *A42B 3/065* (2013.01);
(Continued)

(58) Field of Classification Search
CPC ..... A42B 3/14; A42B 3/046; A42B 3/065; A42B 3/069; A42B 3/121; A42B 3/125; A42B 3/30
(Continued)

(56) References Cited

U.S. PATENT DOCUMENTS 3,344,433 A 10/1967 Stapenhill
3,877,076 A * 4/1975 Summers ..... A42B 3/065 2/414
(Continued)

FOREIGN PATENT DOCUMENTS

CA 2799323 A1 * 11/2011 ..... A42B 3/064
CA 2966658 A1 * 5/2016 ..... A42B 3/0473
(Continued)

OTHER PUBLICATIONS

PCT International Search Report, PCT/US2014/064173, dated Apr. 8, 2015, 5 pp.
(Continued)

*Primary Examiner* — Alissa L Hoey
(74) *Attorney, Agent, or Firm* — Christensen O'Connor Johnson Kindness PLLC

(57) ABSTRACT

The present technology relates generally to protective helmets with non-linearly deforming members. Helmets configured in accordance with embodiments of the present technology can comprise, for example, an inner layer, an outer layer, a space between the inner layer and the outer layer, and an interface layer disposed in the space. The interface layer comprises a plurality of filaments, each
(Continued)

having a height, a longitudinal axis along the height, a first end proximal to the inner layer, and a second end proximal to the outer layer. The filaments are sized and shaped to span the space between the inner layer and the outer layer. The filaments are configured to deform non-linearly in response to an external incident force on the helmet.

30 Claims, 10 Drawing Sheets

Related U.S. Application Data on Jan. 3, 2014, provisional application No. 62/049,049, filed on Sep. 11, 2014, provisional application No. 62/049,161, filed on Sep. 11, 2014, provisional application No. 62/049,190, filed on Sep. 11, 2014, provisional application No. 62/049,207, filed on Sep. 11, 2014.

(51) Int. Cl.
*A42B 3/04* (2006.01)
*A42B 3/12* (2006.01)
*A42B 3/30* (2006.01)

(52) U.S. Cl.
CPC ..... *A42B 3/121* (2013.01); *A42B 3/125* (2013.01); *A42B 3/30* (2013.01)

(58) Field of Classification Search
USPC ..... 2/413
See application file for complete search history.

(56) References Cited

U.S. PATENT DOCUMENTS 4,012,794 A 3/1977 Nomiyama
4,223,409 A * 9/1980 Lee ..... A42B 3/065 2/411
4,307,471 A 12/1981 Lovell
4,972,527 A * 11/1990 Wallace ..... A42B 3/127 2/410
5,531,951 A * 7/1996 Travelute ..... D01D 5/23 264/143
5,956,777 A 9/1999 Popovich
6,658,671 B1 12/2003 Von Holst et al.
7,328,462 B1 2/2008 Straus
8,046,845 B1 * 11/2011 Garcia ..... A42B 3/061 2/2.5
8,087,101 B2 1/2012 Ferguson
8,578,520 B2 11/2013 Halldin
9,314,062 B2 * 4/2016 Marz ..... A42B 3/12
9,462,842 B2 10/2016 Hoshizaki et al.
9,516,910 B2 12/2016 Szalkowski et al.
2004/0117896 A1 6/2004 Madey et al.
2007/0068755 A1 * 3/2007 Hawkins ..... A41D 13/0518 188/371
2008/0155735 A1 7/2008 Ferrara
2011/0143080 A1 * 6/2011 Ortiz ..... F42D 5/045 428/76
2012/0017358 A1 1/2012 Princip et al.
2012/0096631 A1 4/2012 King et al.
2012/0204329 A1 * 8/2012 Faden ..... A41D 31/005 2/413
2012/0233745 A1 * 9/2012 Veazie ..... A42B 3/121 2/413
2012/0297526 A1 11/2012 Leon
2012/0306120 A1 12/2012 Li et al.
2013/0000015 A1 1/2013 Prostar
2013/0000017 A1 1/2013 Szalkowski et al.
2013/0019385 A1 1/2013 Knight et al.
2013/0040524 A1 2/2013 Halldin et al.
2013/0061371 A1 3/2013 Phipps et al.
2013/0122256 A1 5/2013 Kleiven et al.
2013/0152282 A1 * 6/2013 Ellis ..... A43B 7/1425 2/413
2013/0185837 A1 7/2013 Phipps et al.
2013/0298317 A1 * 11/2013 Fonte ..... A41D 13/015 2/414
2013/0330502 A1 12/2013 Lewis et al.
2014/0000012 A1 * 1/2014 Mustapha ..... H01F 7/02 2/414
2014/0013492 A1 1/2014 Bottlang et al.
2014/0196198 A1 7/2014 Cohen
2014/0208486 A1 * 7/2014 Krueger ..... A42B 3/064 2/414
2014/0215694 A1 * 8/2014 Grice ..... A42B 3/064 2/411
2015/0223547 A1 * 8/2015 Wibby ..... A42B 3/125 2/414
2015/0230535 A1 * 8/2015 McGuckin, Jr. ..... A42B 3/122 2/413
2016/0278470 A1 * 9/2016 Posner ..... A42B 3/124
2017/0065018 A1 * 3/2017 Lindsay ..... A42B 3/067
2017/0105470 A1 * 4/2017 Eaton ..... A42B 3/064
2017/0196292 A1 * 7/2017 Reinhall ..... A42B 3/063
2017/0295880 A1 * 10/2017 Kennedy ..... A42B 3/064
2017/0303622 A1 * 10/2017 Stone ..... A42B 3/064
2018/0077989 A1 * 3/2018 Horstemeyer ..... A42B 3/065
2018/0092420 A1 * 4/2018 Lewis ..... A42B 3/069

FOREIGN PATENT DOCUMENTS

CN 1543318 A 11/2004
GB 1578351 A 11/1980
JP 2007-254920 A 4/2007
WO WO 2013/079989 A1 6/2013
WO WO 2015/069800 A2 5/2015

OTHER PUBLICATIONS

PCT International Search Report and Written Opinion, PCT Application No. PCT/US2016/023847, dated Jun. 7, 2016, 14 pages.
PCT International Search Report, PCT Application No. PCT/US14/64173, dated Apr. 8, 2015, 5 pages.
"MIPS | Patented Brain Protection System," MIPS AB, undated, [Online] [Retrieved on Aug. 1, 2016] Retrieved from the Internet<URL:http://www.mpsprotection.com/>.
POC: Crane Mips Helmets, POC Sweden AB, 2 pages, undated, [Online] [Retrieved on Aug. 2, 2016] Retrieved from the Internet<URL:http://www.pocsports.com/en/content/view/new-technologies>.
Canadian First Office Action, Canadian Application No. 2,928,241, dated Feb. 9, 2017, 4 pages.
Canadian Office Action, Canadian Application No. 2,928,241, dated Nov. 27, 2017, 4 pages.
Chinese First Office Action, Chinese Application No. 201480060473.9, dated Jun. 28, 2017, 15 pages.
Chinese Second Office Action, Chinese Application No. 201480060473.9, dated Jan. 31, 2018, 15 pages. (with concise explanation of relevance).
European Extended Search Report, European Application No. 14861065.2, dated Sep. 11, 2017, 7 pages.
Non-Final Office Action dated Sep. 26, 2018, in corresponding Canadian Application No. 2,928,241, filed Nov. 5, 2014, 4 pages.
Third Office Action dated Jul. 26, 2018, issued in corresponding Chinese Application No. 201480060473.9, filed Nov. 5, 2014, 16 pages.
Non-Final Office Action dated May 11, 2018, from U.S. Appl. No. 15/078,848, filed Mar. 23, 2016, 14 pages.
Rejection Decision dated Feb. 13, 2019, issued in corresponding Chinese Application No. 201480060473.9, filed Nov. 5, 2019, 25 pages.
Extended European Search Report dated Feb. 20, 2019, issued in corresponding European Application No. 16769643.4, filed Mar. 23, 2016, 10 pages.

(56) References Cited

OTHER PUBLICATIONS

Supplementary Partial European Search Report dated Nov. 9, 2018, filed in corresponding European Application No. 16769643.4, filed Mar. 23, 2016, 11 pages.
Communication Pursuant to Article 94(3) EPC dated Mar. 25, 2019, issued in corresponding European Application No. 14861065.2, filed Nov. 5, 2014, 7 pages.
Official Notice of Rejection dated Dec. 4, 2018, issued in corresponding Japanese Application No. 2016-552473, filed Nov. 5, 2014, 21 pages.
Examination Report dated Oct. 8, 2019, for European Application No. 14861065.2. (6 pages).
Office Action for Japanese Patent Application No. 2016-552473, dated Jul. 30, 2019. (with English Translation, 18 pages).
Communication Pursuant to Article 94(3) EPC, dated Dec. 19, 2019, for European Patent Application No. 16769643.4. (4 pages).

* cited by examiner

PROTECTIVE HELMETS WITH NON-LINEARLY DEFORMING ELEMENTS

CROSS-REFERENCE TO RELATED APPLICATION(S)

This application claims the benefit of the following applications:

(a) U.S. Provisional Patent Application No. 61/900,212, filed Nov. 5, 2013;

(b) U.S. Provisional Patent Application No. 61/923,495, filed Jan. 3, 2014;

(c) U.S. Provisional Patent Application No. 62/049,049, filed Sep. 11, 2014;

(d) U.S. Provisional Patent Application No. 62/049,161, filed Sep. 11, 2014;

(e) U.S. Provisional Patent Application No. 62/049,190, filed Sep. 11, 2014; and (f) U.S. Provisional Patent Application No. 62/049,207, filed Sep. 11, 2014.

All of the foregoing application are incorporated herein by reference in their entireties. Further, components and features of embodiments disclosed in the applications incorporated by reference may be combined with various components and features disclosed and claimed in the present application.

TECHNICAL FIELD

The present technology is generally related to protective helmets. In particular, several embodiments are directed to protective helmets with non-linearly deforming elements therein.

BACKGROUND

Sports-related traumatic brain injury, and specifically concussion, have become major concerns for the NFL, the NCAA, football teams and participants at all levels. Such injuries are also significant concerns for participants in other activities such as cycling and skiing. Current helmet technology is inadequate, as it primarily protects against superficial head injury and not concussions that can be caused by direct or oblique forces. Additionally, currently available helmets absorb incident forces linearly, which transmits the bulk of the incident force to the head of the wearer.

DETAILED DESCRIPTION

The present technology is generally related to protective helmets with non-linearly deforming elements therein. Embodiments of the disclosed helmets, for example, comprise an inner layer, an outer layer, and an interface layer disposed in a space between the inner and outer layers. The interface layer can include a plurality of filaments configured to deform non-linearly in response to an incident force.

Specific details of several embodiments of the present technology are described below with reference to FIGS. 1A-12. Although many of the embodiments are described below with respect to devices, systems, and methods for protective helmets, other embodiments are within the scope of the present technology. Additionally, other embodiments of the present technology can have different configurations, components, and/or procedures than those described herein. For example, other embodiments can include additional elements and features beyond those described herein, or other embodiments may not include several of the elements and features shown and described herein.

For ease of reference, throughout this disclosure identical reference numbers are used to identify similar or analogous components or features, but the use of the same reference number does not imply that the parts should be construed to be identical. Indeed, in many examples described herein, the identically numbered parts are distinct in structure and/or function.

Selected Embodiments of Protective Helmets

Figure 1A:
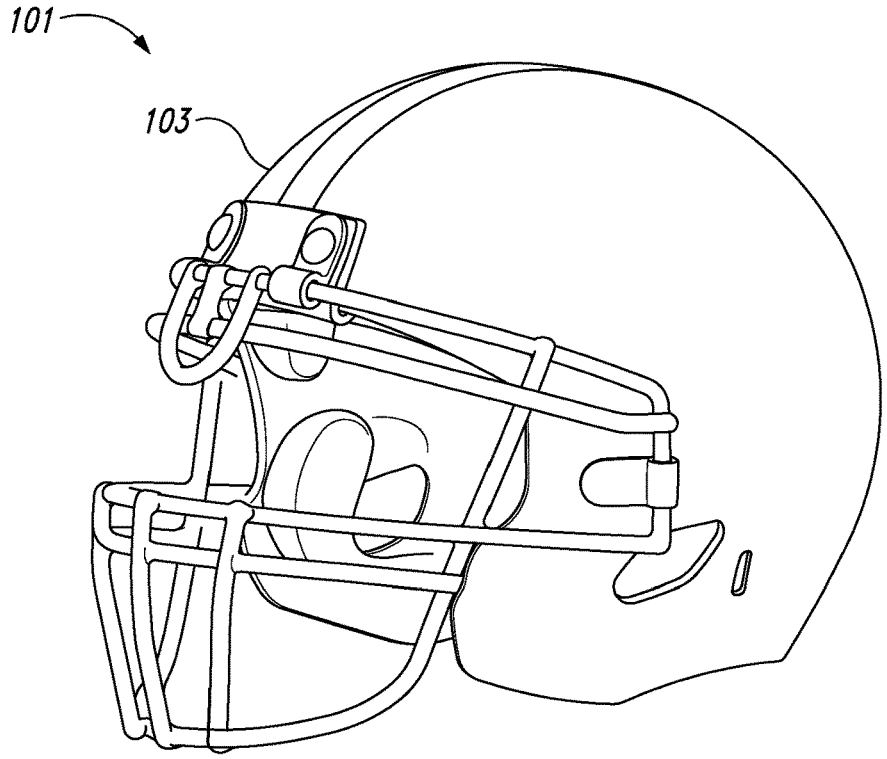
FIG. 1A is a perspective view of a protective helmet configured in accordance with embodiments of the present technology.
Figure 1B:
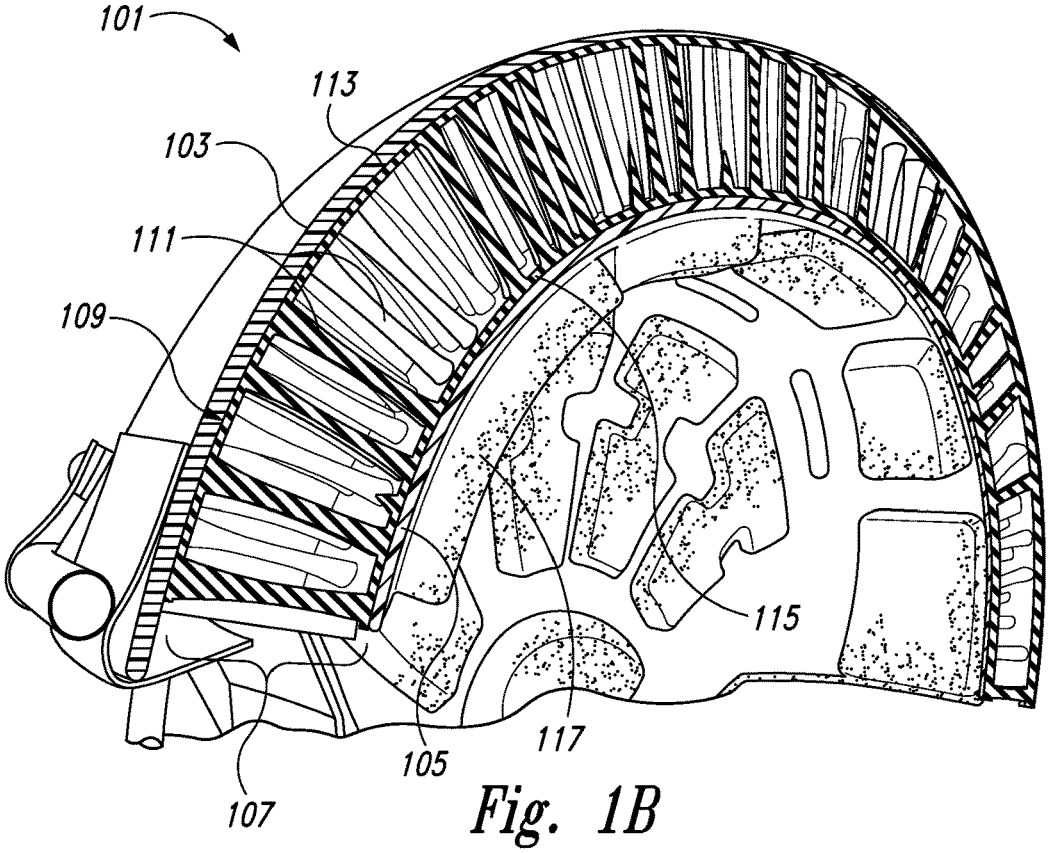
FIG. 1B is a perspective cross-sectional view of the protective helmet shown in FIG. 1A.

FIG. 1A is a perspective view of a protective helmet 101 configured in accordance with embodiments of the present technology. FIG. 1B is a perspective cross-sectional view of the helmet shown in FIG. 1A. Referring to FIGS. 1A and 1B together, the helmet 101 comprises an outer layer 103, an inner layer 105, and space or gap 107 between the outer layer 103 and the inner layer 105. An interface layer 109 comprising a plurality of filaments 111 is disposed in the space 107 between the outer layer 103 and the inner layer 105. In the illustrated embodiment, the filaments 111 extend between an outer surface 113 adjacent to the outer layer 103 and an inner surface 115 adjacent to the inner layer 105, and span or substantially span the space 107. Padding 117 is disposed adjacent to the inner layer 105. The padding 117 can be configured to comfortably conform to a head of the wearer (not shown).

In some embodiments, the outer layer 103 of the helmet 101 may be composed of a single, continuous shell. In other embodiments, however, the outer layer 103 may have a different configuration. The outer layer 103 and the inner layer 105 can also both be relatively rigid (e.g., composed of a hard plastic material). The outer layer 103, however, can be pliable enough to locally deform when subject to an incident force. In certain embodiments, the inner layer 105 can be relatively stiff, thereby preventing projectiles or intense impacts from fracturing the skull or creating hematomas. In some embodiments, the inner layer 105 can be at least five times more rigid than the outer layer 103. In some embodiments, the outer layer 103 may also comprise a plurality of deformable beams that are flexibly connected and arranged so that the longitudinal axes of the beams are substantially parallel to the surface of the outer layer. Further, in some embodiments each of the deformable beams can be flexibly connected to at least one other deformable beam and at least one filament.

The filaments 111 can comprise thin, columnar or elongated structures configured to deform non-linearly in response to an incident force on the helmet 101. Such structures can have a high aspect ratio, e.g., from 3:1 to 1000:1, from 4:1 to 1000:1, from 5:1 to 1000:1, from 100:1 to 1000:1, etc. The non-linear deformation of the filaments 111 is expected to provide improved protection against high-impact direct forces, as well as oblique forces. More specifically, the filaments 111 can be configured to buckle in response to an incident force, where buckling may be characterized by a sudden failure of filament(s) 111 subjected to high compressive stress, where the actual compressive stress at the point of failure is less than the ultimate compressive stresses that the material is capable of withstanding. The filaments 111 can be configured to deform elastically, so that they substantially return to their initial configuration once the external force is removed.

At least a portion of the filaments 111 can be configured to have a tensile strength so as to resist separation of the outer layer 103 from the inner layer 105. For example, during lateral movement of the outer layer 103 relative to the inner layer 105, those filaments 111 having tensile strength may exert a force to counteract the lateral movement of the outer layer 103 relative to the inner layer 105. In some embodiments, there may be wires, rubber bands, or other elements embedded in or otherwise coupled to the filaments 111 in order to impart additional tensile strength.

As shown in the embodiment illustrated in FIG. 1B, for example, the filaments 111 may be directly attached to the outer layer 103 and/or directly attached to the inner layer 105. In some embodiments, at least some of the filaments 111 can be free at one end, with an opposite end coupled to an adjacent surface. Due to the flexibility of the filaments 111, the outer layer 103 can move laterally relative to the inner layer 105. In some embodiments, the filaments 111 can optionally include a rotating member at one or both ends that is configured to rotatably fit within a corresponding socket in the inner or outer layers. In some embodiments, at least some of the filaments 111 can be substantially perpendicular to the inner surface 115, the outer surface 113, or both.

The filaments 111 may be composed of a variety of suitable materials, such as a foam, elastomeric material, polymeric material, or any combination thereof. In some embodiments, the filaments can be made of a shape memory material and/or a self-healing material. Furthermore, in some embodiments, the filaments may exhibit different shear characteristics in different directions.

In some embodiments, the helmet 101 can be configured to deform locally and elastically in response to an incident force. In particular embodiments, for example, the helmet 101 can be configured such that upon application of between about 100 and 500 static pounds of force, the outer layer 103 and interface layer 109 deform between about 0.75 to 2.25 inches. The deformability can be tuned by varying the composition, number, and configuration of the filaments 111, and by varying the composition and configuration of the outer layer 103 and inner layer 105.

Figure 2A:
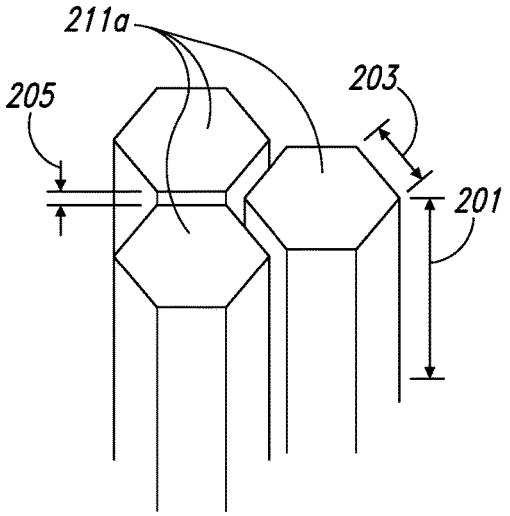
FIG. 2A-C illustrate various embodiments of filaments configured for an interface layer of a protective helmet configured in accordance with the present technology.
Figure 2B:
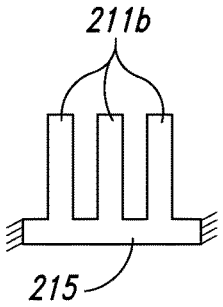
Figure 2C:
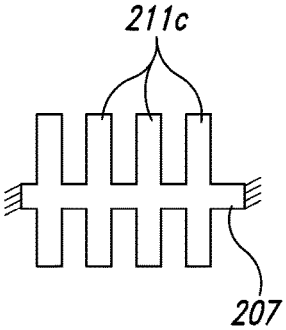

FIG. 2A-C illustrate various embodiments of filaments configured for an interface layer (e.g., interface layer 109) of a protective helmet (e.g., helmet 101) in accordance with embodiments of the present technology. Referring to FIG. 2A, for example, a plurality of filaments 211*a* have a cross-sectional shape of regular polygons. Individual filaments 211*a* have a height 201, a width 203, and a spacing 205 between adjacent filaments 211*a*. Referring to FIG. 2B, filaments 211*b* can be connected to an inner surface 215 at one end, and can be free at the opposite end. In FIG. 2C, filaments 211*c* can be coupled to a spine 207 at a middle point of the filaments 211*c*, such that the filaments 211*c* extend outwardly in opposite directions from the spine 207. Referring to FIGS. 2A-2C together, the filaments 211*a-c* can assume any suitable shape, including cylinders, hexagons (inverse honeycomb), square, irregular polygons, random, etc. The point of connection between the filaments 211*a-c* and the inner surface 215 or the spine 207, the dimensions 201, 203, and 205, the filament material, the material in the space between the filaments 211*a-c*, can all be modified to tune the orthotropic properties of the filaments. This tunability is expected to provide desired deformation properties and can be varied between different regions of the interface layer. The filaments 211*a-c* can be made from any material that allows for large elastic deformations including, for example, foams, elastic foams, plastics, etc. The spacing between filaments 211*a-c* can be filled with gas, liquid, or complex fluids, to further tune overall structure material properties. In some embodiments, for example, the space can be filled with a gas, a liquid (e.g., a shear thinning or shear thickening liquid), a gel (e.g., a shear thinning or shear thickening gel), a foam, a polymeric material, or any combination thereof.

Figure 3A:
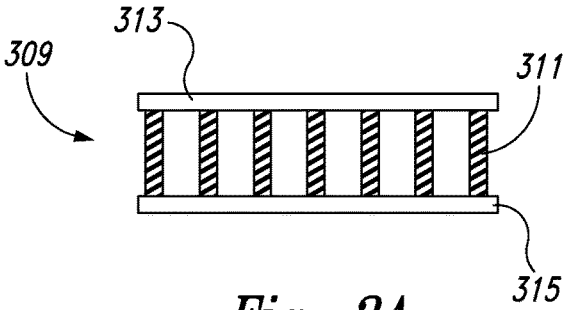
FIG. 3A-D illustrate deformation of portion of an interface layer configured in accordance with embodiments of the present technology.
Figure 3B:
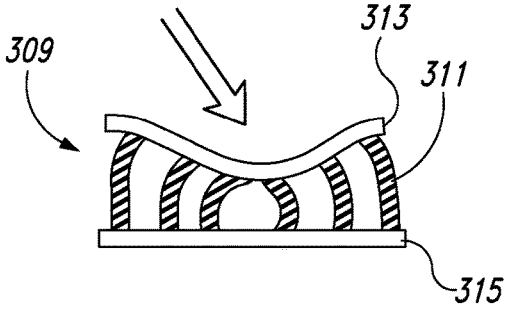
Figure 3C:
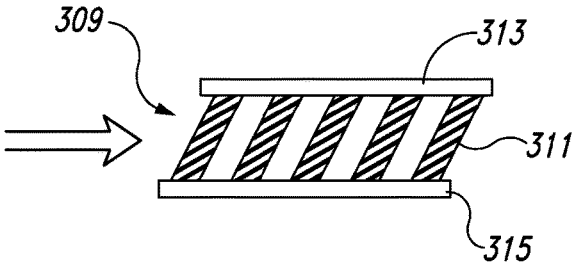
Figure 3D:
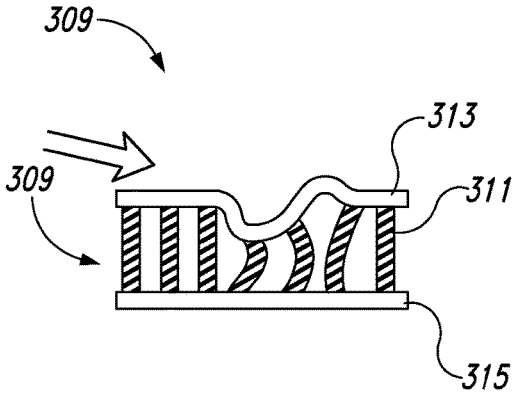

FIG. 3A-D illustrate deformation of an interface layer 309 having an outer surface 313, an inner surface 315, and a plurality of filaments 311 extending between the outer surface 313 and the inner surface 315. FIG. 3A, for example, illustrates the interface layer 309 without an external force applied. In FIG. 3B, a downward force $F_1$ is applied to the outer surface 313, resulting in deformation of a portion of the filaments 311. FIG. 3C illustrates translation of the outer surface 313 with respect to the inner surface 315 in response to a tangential force $F_2$. In FIG. 3D, a vertical and tangential force $F_3$ results in deformation of the filaments 311. Oblique and/or tangential forces that are distributed over a larger area of the outer surface 313 can result in shear of the filaments 311 or local buckling of some of the filaments 311.

Figure 4A:
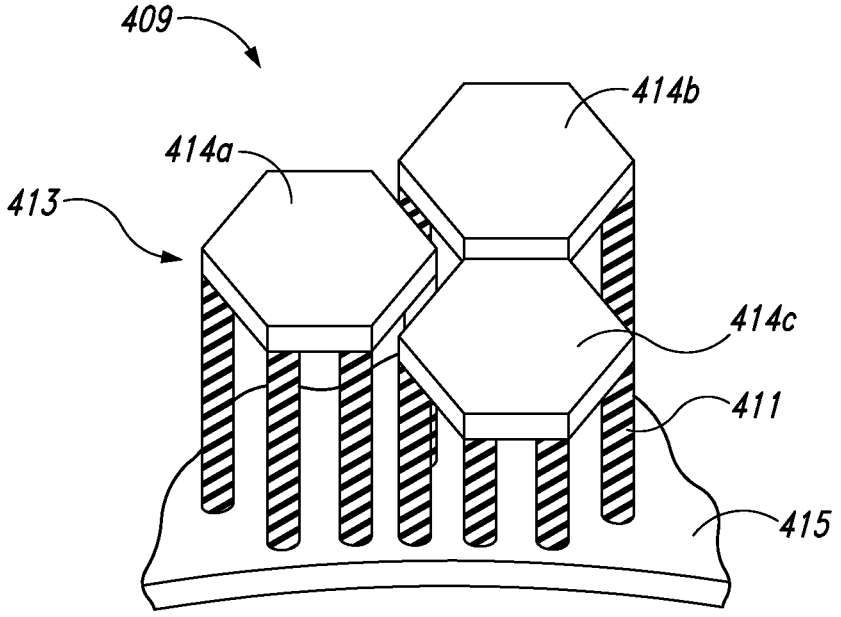
FIGS. 4A and 4B illustrate an interface layer including a plurality of segmented tiles in accordance with embodiments of the present technology.
Figure 4B:
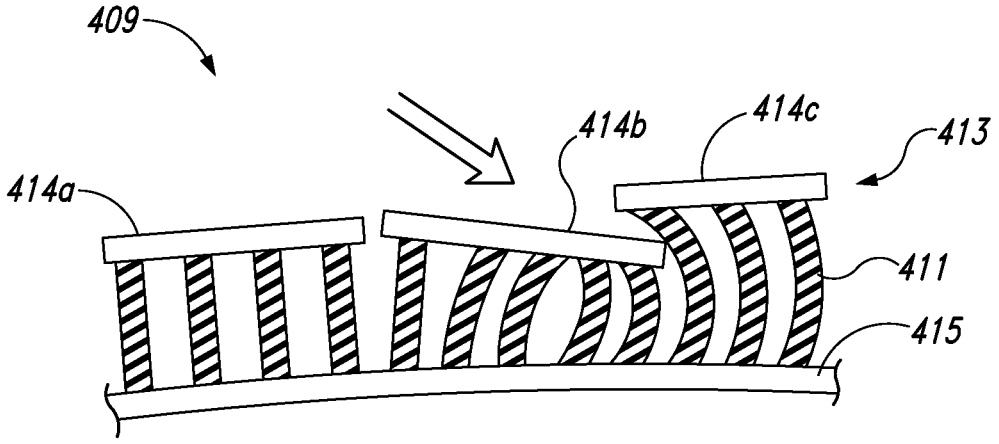

FIGS. 4A and 4B illustrate an interface layer 409 including a plurality of segmented tiles configured in accordance with embodiments of the present technology. A plurality of filaments 411 are affixed to and extend away from an inner surface 415. An outer surface 413 of the interface layer 409 is divided into a plurality of segmented tiles 414 (three are shown as tiles 414*a-c*). As best seen in FIG. 4B, the filaments 411 throughout the interface layer 409 share the common inner surface 415, but only a subset of the filaments 411 are coupled together to define individual segmented tiles 414*a-c*. In FIGS. 4A and 4B, the tiles 414*a-c* are shown as packed hexagons, but in other embodiments the tiles 414*a-c* could take other shapes including regular and irregular polygons, cylinders, etc. The tiles 414 are arranged to allow for a set of filaments 411 to respond to local impact forces and buckle, shear, or otherwise move relative to the other neighboring tiles 414. In some embodiments, some tiles 414 can be configured to move on top of or below neighboring tiles 414 in response to impact forces. In certain embodiments, the tiles 414 may be flexibly connected to one another. The tiles 414*a-c* can be configured to tessellate with each other. The space between the tiles 414*a-c* can be air, or the space may be filled with a different material (e.g. foam, liquid, gel, etc.).

Figure 5A:
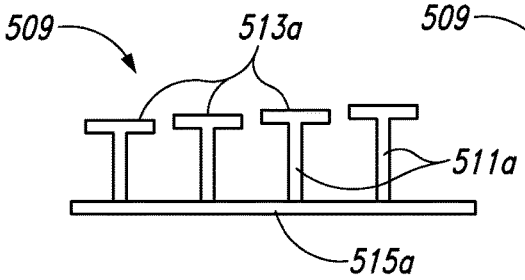
FIGS. 5A-I illustrate various filament configurations and shapes in accordance with embodiments of the present technology.
Figure 5B:
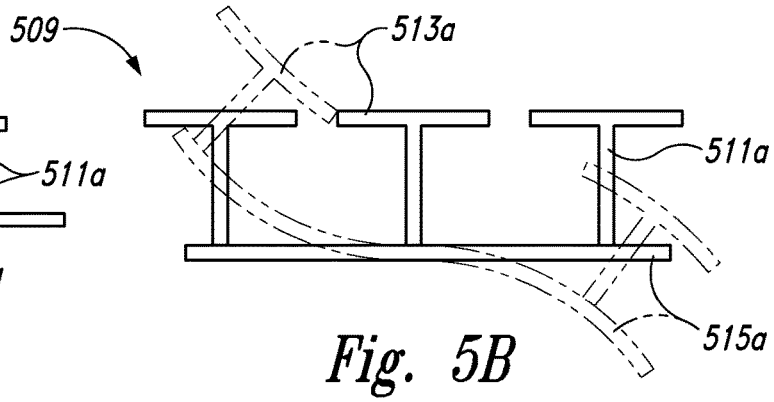
Figure 5C:
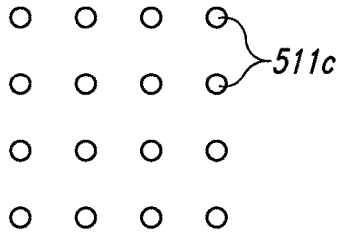
Figure 5D:
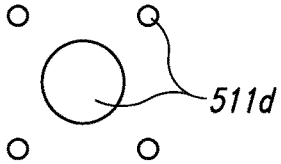

FIGS. 5A-5I illustrate various filament configurations and shapes in accordance with embodiments of the present technology. The filaments of FIGS. 5A-5I may be used with any of the interface layers disclosed herein. Referring first to FIG. 5A, for example, an interface layer 509 comprises a plurality of filaments 511*a* extending from an inner surface 515*a*, with an outer surface 513*a* divided into separate discrete portions. FIG. 5B illustrates the interface layer 509 being flexibly curved. For example, the interface layer 509 may be curved to correspond to the curvature of a helmet. The material of the filaments 511*a*, the outer surface 113*a*, and/or the inner surface 115*a* can be flexible to permit such bending.

Figure 5E:
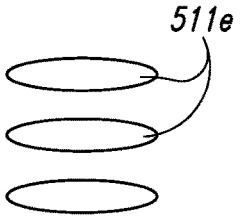
Figure 5F:
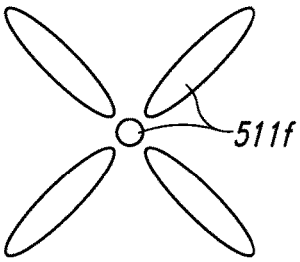
Figure 5G:
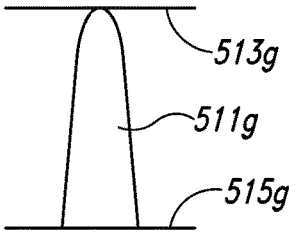
Figure 5H:
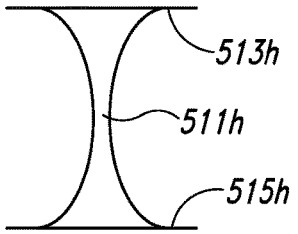
Figure 5I:
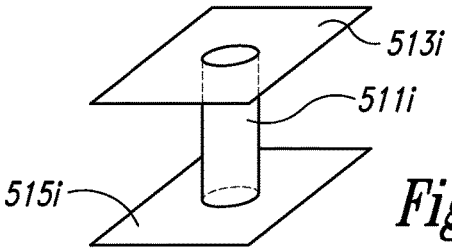

FIGS. 5C-F illustrate plan views of an arrangement of filaments 511*c-i* in the interface layer 509. The filaments 511*c* can have a uniform size and shape, and be distributed isotropically (as in FIG. 5C). With respect to FIG. 5D, some filaments 511*d* are larger than others, and they can be distributed non-uniformly. In FIGS. 5E and 5F, the filaments 511*e* assume irregular shapes and patterns. FIGS. 5G-5I illustrate side views of single filaments 511*g-i* having various configurations. In FIG. 5G, for example, the filament 511*g* is connected to the inner surface 515*g*, but is separated from the outer surface 513*g*. In FIG. 5H, the filament 511*h* has a varying thickness along its length. In FIG. 5I, the filament 511*h* is hollow, for example a hollow cylinder. In certain embodiments, one or more of the filaments can be hollow, such that the filament includes a lumen that extends a portion of the distance along the height of the filament. The arrangement, size, and shape of the filaments can be varied to achieve the desired mechanical properties of the corresponding interface layer, for example deformation properties, stiffness, etc.

Figure 13:
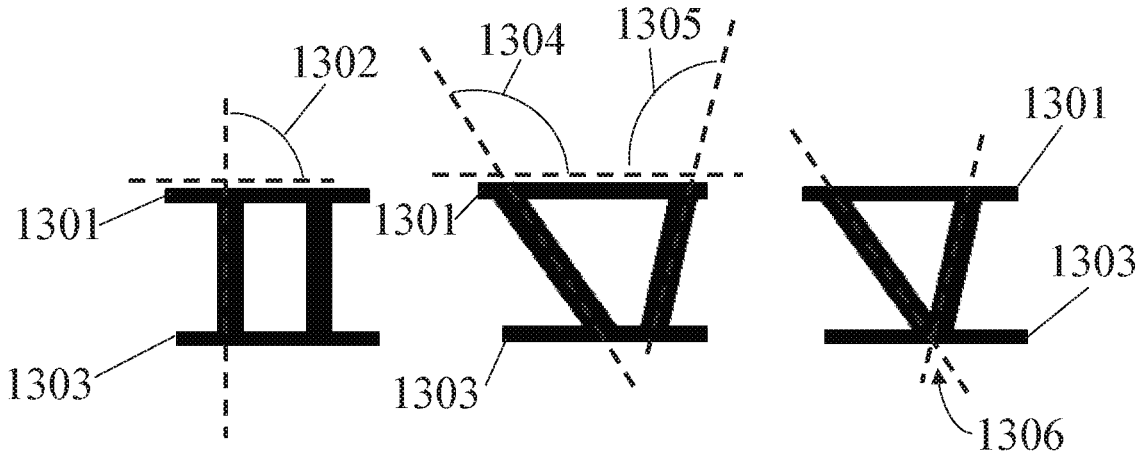
FIG. 13 is an enlarged view of one embodiment of filaments in different orientations.

In some embodiments, the filaments can be disposed between the outer surface and the inner surface such that a longitudinal axis of the filament is not perpendicular to either the outer surface 1301 or the inner surface 1303 as shown in FIG. 13. In some embodiments, the angle of the longitudinal axis of a first subset of filaments 1304 relative to at least one of the outer surface 1301 and/or inner surface 1303 can be supplementary to the angle of the longitudinal axis of a second subset of filaments 1305 relative to the outer surface 1301 and/or the inner surface 1303. For example, a first filament can have a longitudinal axis disposed at a 30 degree angle with respect to the inner surface, and a second filament can have a longitudinal axis disposed at a 150 degree angle with respect to the inner surface. In some embodiments, the first and second filaments can be connected to one another at an intersection point 1306.

Figure 6:
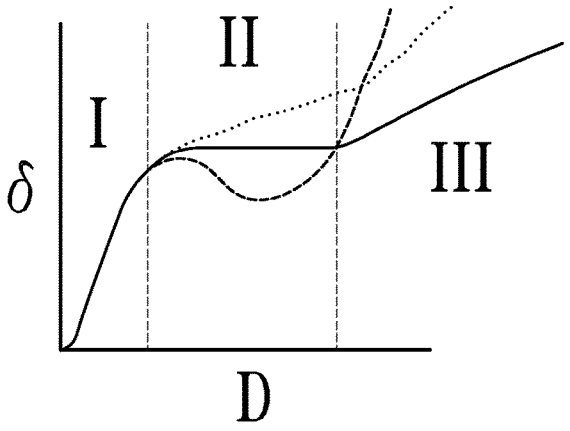
FIG. 6 is a graph of the stress-strain behavior of an interface layer configured in accordance with embodiments of the present technology.

FIG. 6 is a graph of stress-strain behavior of the interface layer in accordance with embodiments of the present technology. As illustrated, as the strain (D) increases, the stress (σ) initially increases rapidly in region I. Next, in region II, the stress is relatively flat, followed by a further increase of the stress in region III. This nonlinear relationship exhibits behavior similar to those observed in buckling in which there is an initial stiff region (region I), followed by a rapid transition to a flat, decreasing, or increasing slope (region II), followed by a third region with a different slope (region III). As depicted in FIG. 6, the dashed lines illustrate possible alternative stress-strain profiles for an interface layer. As the materials, arrangement and configuration of filaments within the interface layer are varied, the stress-strain relationship can be adjusted to achieve a desired profile. In some embodiments, the interface layer can be orthotropic (i.e., exhibiting different nonlinear stress-strain behaviors for different components of stress).

Figure 7:
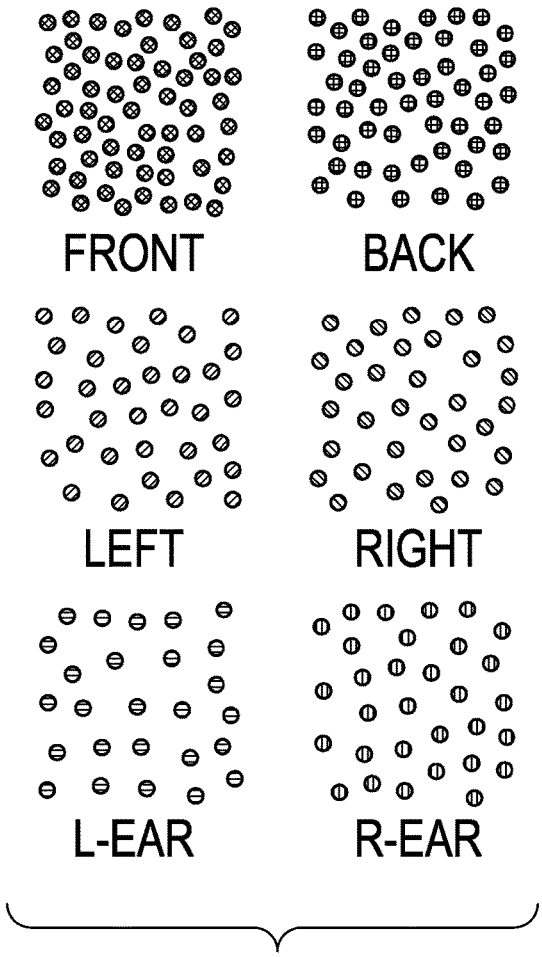
FIG. 7 illustrates a variety of filament densities for the interface layer in accordance with embodiments of the present technology.

FIG. 7 illustrates a variety of filament densities for a protective helmet in accordance with embodiments of the present technology. As noted above, a protective helmet can include an interface layer comprising a plurality of filaments therein. The deformation characteristics of the interface layer can be adjusted/tuned based on a composition and arrangement of the filaments. As illustrated in FIG. 7, the arrangement and density of filaments can vary at different locations of the helmet. For example, the density of filaments may be greatest in the front and back portions, with a lower density of filaments on left and right, and an even lower density of filaments over the left and right ears. Because a wearer of the help may be at greater risk of receiving a high-impact force from the front or back, those portions of the helmet can have a greater density of filaments that the portion of the helmet than over the wearer's ear. The density and configuration of filaments can accordingly be varied across the helmet to account for the types and frequencies of impact expected.

Figure 8:
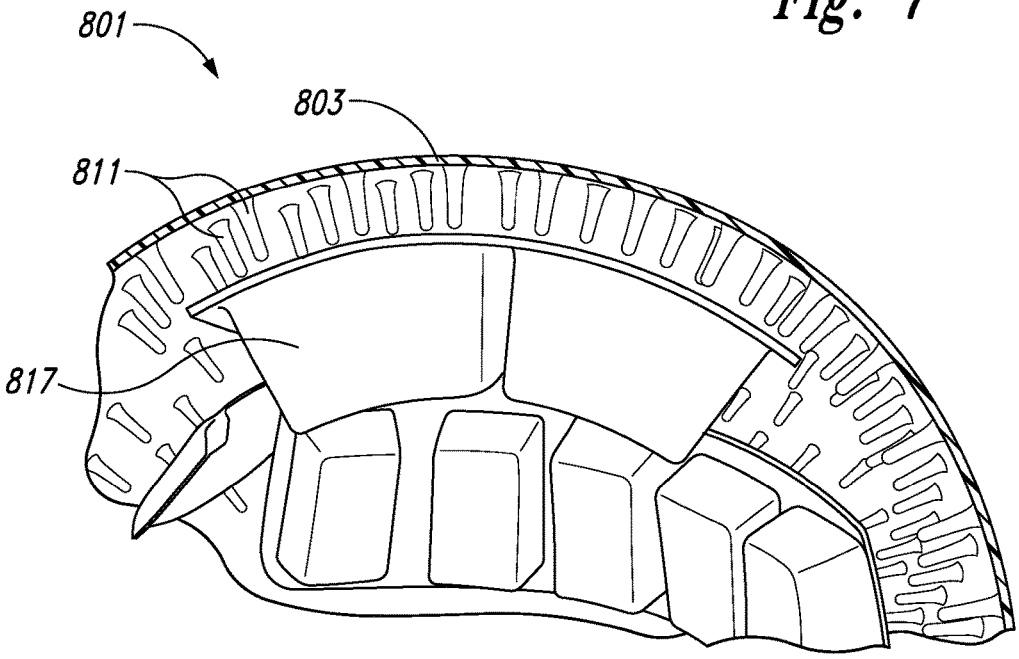
FIG. 8 is a cross-sectional view of a protective helmet having an interface layer with a plurality of filaments extending from an outer surface of the helmet in accordance with embodiments of the present technology.
Figure 14:
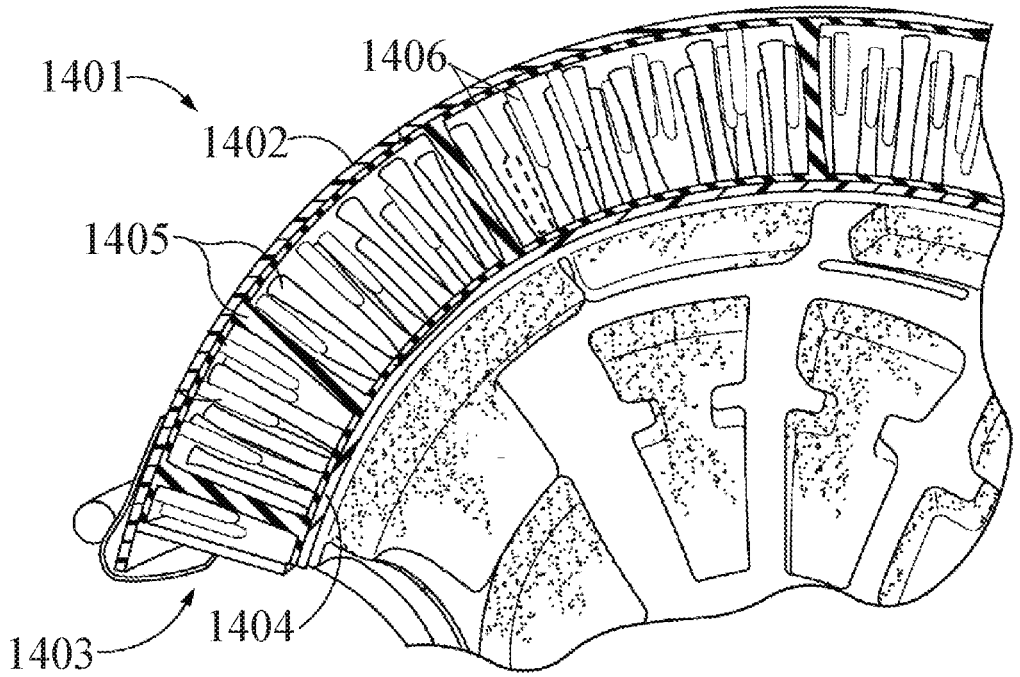
FIG. 14 are cross-section views of a protective helmet with filaments positioned relative to the inner layer.

FIG. 8 is a cross-sectional view of a protective helmet 801 having a plurality of filaments 811 extending from the outer layer 803. As illustrated, the filaments 811 are not attached to an inner layer. Padding 817 is disposed inward from the filaments 811. This configuration can allow for tunable shear characteristics, as well as tunable non-linear deformation of the filaments 811. Alternatively, FIG. 14 is a cross-sectional view of a protective helmet 1401 having an outer layer 1402, and inner layer 1404, and an interface layer 1403 disposed between the outer layer 1402 and the inner layer 1404. The interface layer 1403 comprises a plurality of filaments 1405 extending from the inner layer 1404.

Figure 9A:
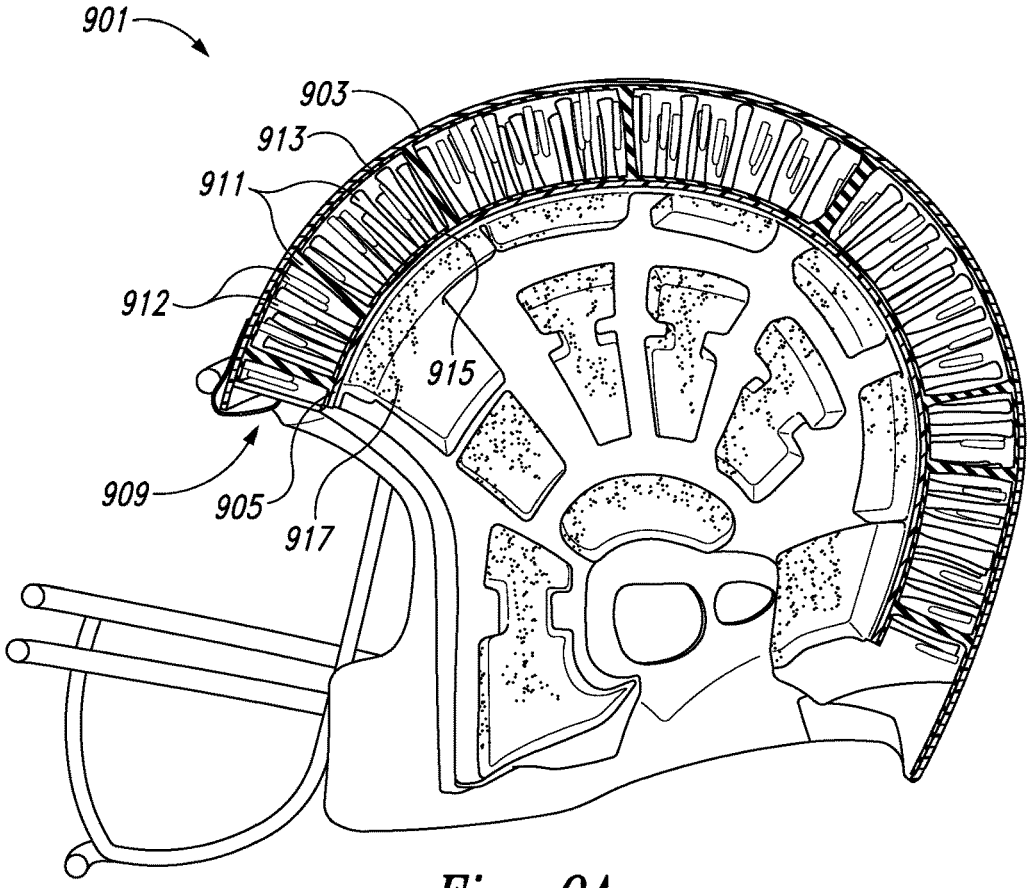
FIG. 9A is a cross-sectional view of a protective helmet having an interface layer with two different types of filaments configured in accordance with embodiments of the present technology.
Figure 9B:
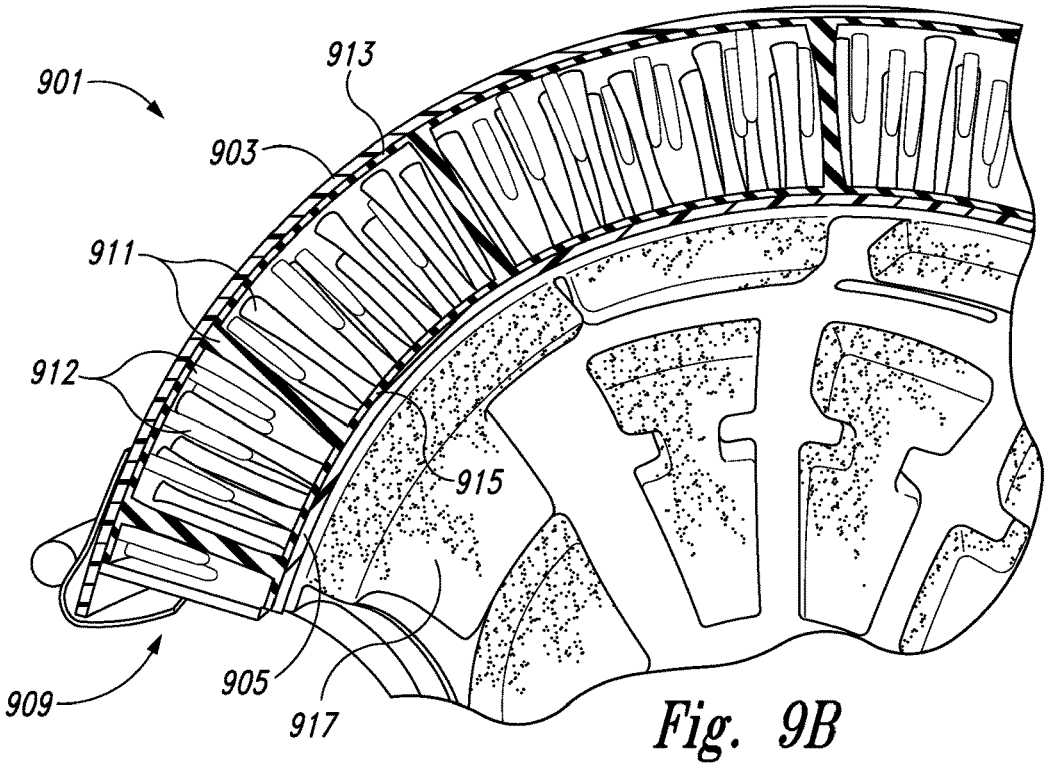
FIG. 9B is an enlarged detail view of the protective helmet shown in FIG. 9A.
Figure 9C:
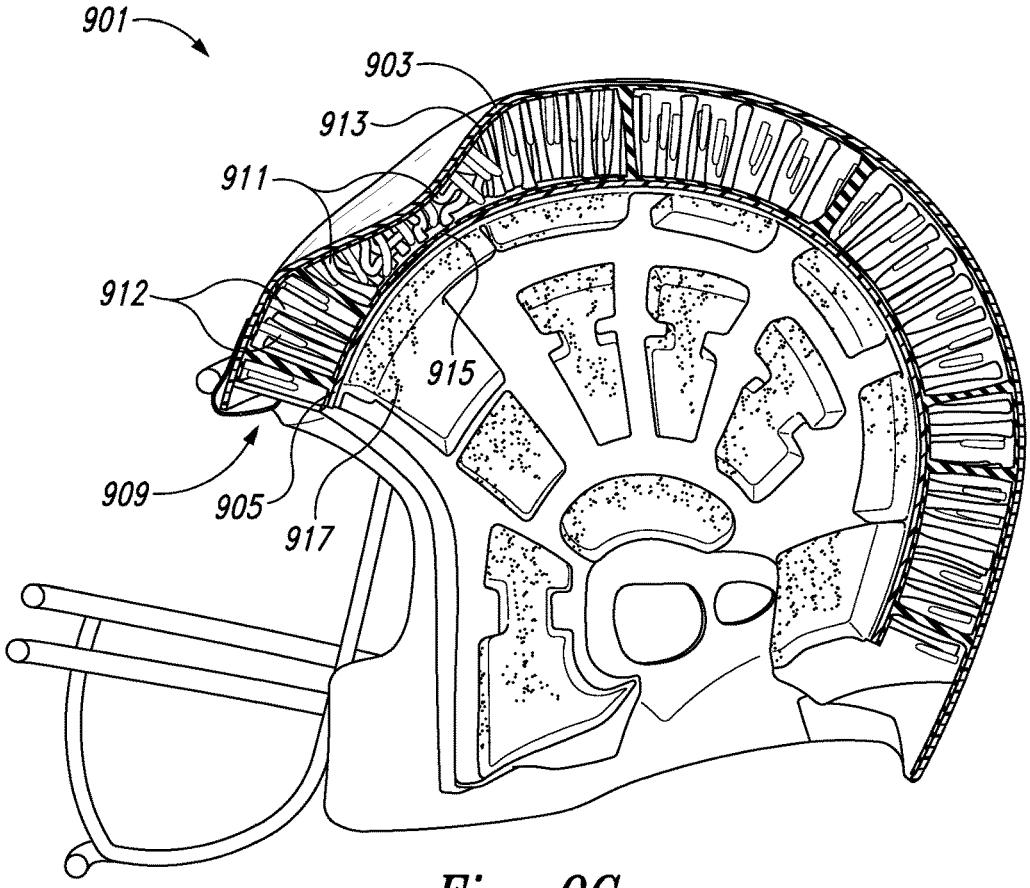
FIG. 9C is a cross-sectional view of the protective helmet shown in 9A under local deformation.
Figure 9D:
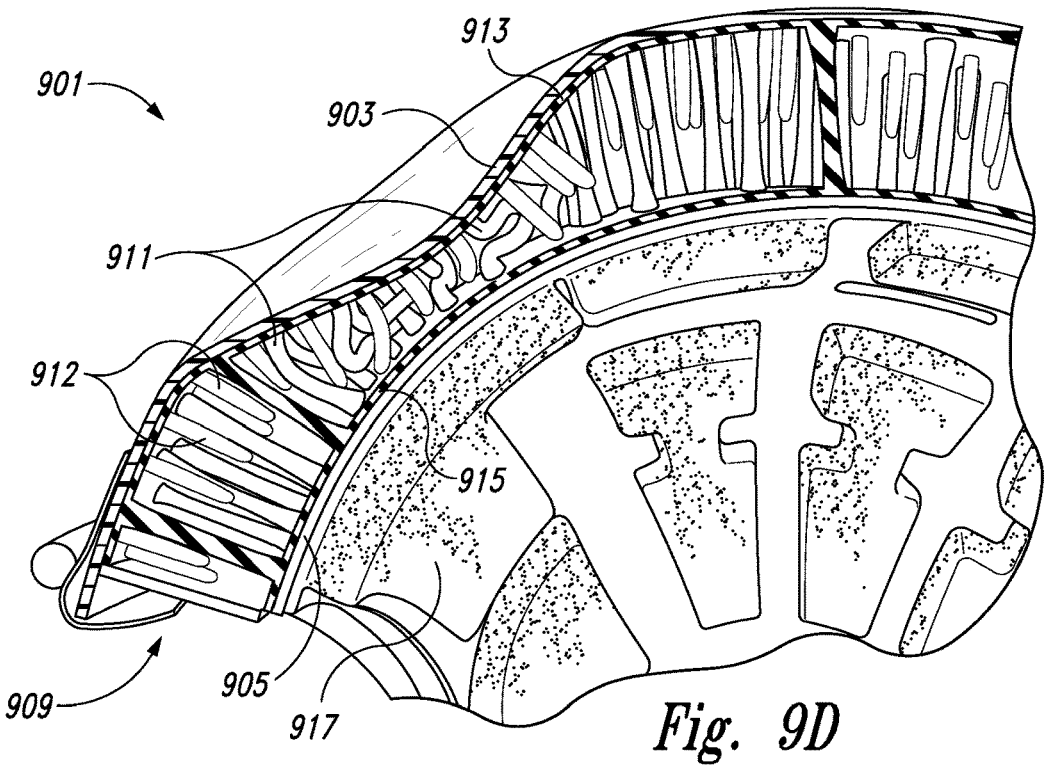
FIG. 9D is an enlarged detail view of the protective helmet shown under local deformation in FIG. 9C.

FIG. 9A is a cross-sectional view of a protective helmet 901 having an interface layer 909 with two different types of filaments 911 and 912 configured in accordance with embodiments of the present technology. FIG. 9B is an enlarged detail view of a portion of the helmet 901. Referring to FIGS. 9A and 9B together, the helmet 901 comprises an outer layer 903, an inner layer 905, and an interface layer 909 disposed between the outer layer 903 and the inner layer 905. The interface layer 909 comprises a first plurality of filaments 911 that span or substantially span the space between the inner layer 905 and the outer layer 903. The interface layer 909 also comprises a second plurality of filaments 912 that do not substantially span the space. Padding 917 is disposed adjacent to inner layer 905. The inclusion of two different types of filaments, each having different shapes, lengths, and/or stiffnesses, is expected to provide increased control of the overall material characteristics of the interface layer 909. For example, in some embodiments the second filaments 912 can be shorter and stiffer than the first filaments 911. Upon initial deformation of the outer layer 103, the first filaments 911 can provide some resistance. Once the outer layer 903 has compressed enough that the second plurality of filaments 912 come into contact with the more rigid inner layer 905, the second plurality of filaments 912 can contribute to a greater resistance of the interface layer 909 to the impact force. FIGS. 9C and 9D, for example, illustrate the protective helmet 901 under local deformation. The first and second filaments 911 and 912 both deform non-linearly in response to the impact force incident on the outer layer 903 of the helmet 901. The deformation can be elastic, such that after impact the interface layer 909 and outer layer 903 return to their original configurations. In some embodiments, the helmet 901 can be configured such that upon application of between about 100 and 500 static pounds of force, the outer layer 903 and interface layer 909 deform between about 0.75 to 2.25 inches. The deformability can be tuned by varying the composition, number, and configuration of the filaments 911, and by varying the composition and configuration of the outer layer 903 and inner layer 905.

Figure 10:
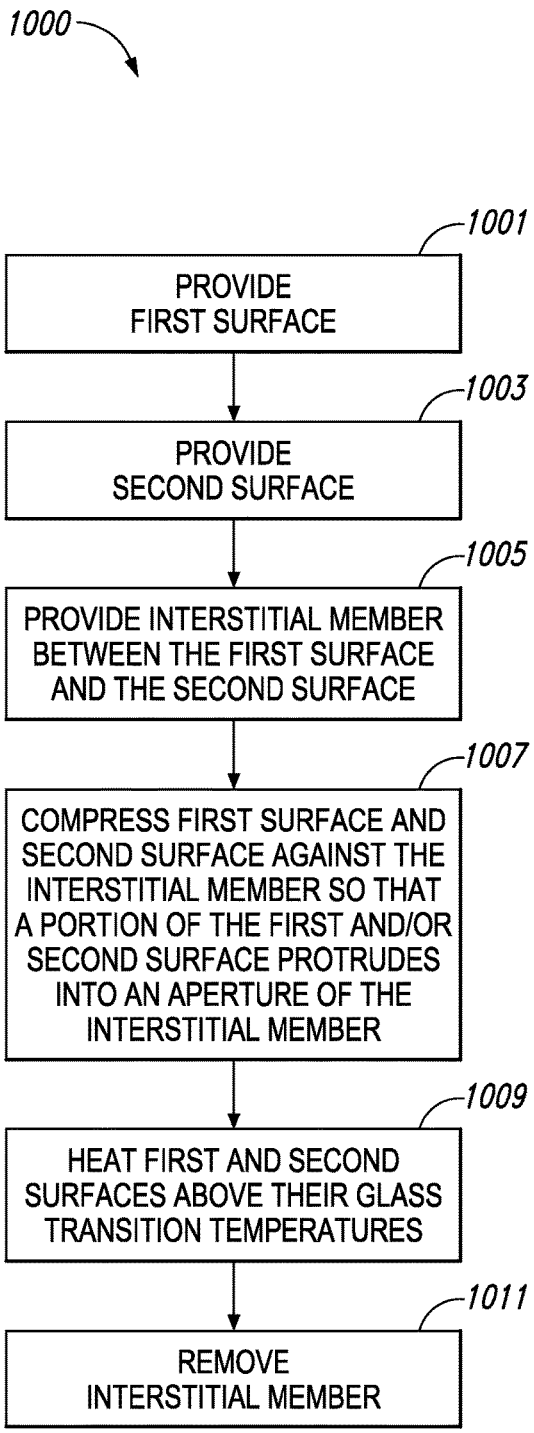
FIG. 10 is a flow diagram of a method of manufacturing an interface layer in accordance with embodiments of the present technology.

Selected Embodiments of Methods for Manufacturing Interface Layers for Protective Helmets FIG. 10 is a flow diagram of a method of manufacturing an interface layer in accordance with embodiments of the present technology. The process 1000 begins in block 1001 by providing a first surface. The first surface can be, for example, a sheet of a polymer, plastic, foam, elastomer, or other material suitable for forming filaments. Process 1000 continues in block 1003 by providing a second surface. In some embodiments, the second surface can have similar characteristics to the first surface. In block 1005, an interstitial member is provided between the first surface and the second surface. The interstitial member can be, for example a plate having a plurality of apertures therein. The apertures can define the cross-sectional shapes and the distribution of the ultimate filaments to be formed between the first and second surfaces. For example, in some embodiments one or more of the apertures can assume the shape of a square, a rectangle, a triangle, an ellipse, a regular polygon, or other shape. In block 1007, the first and second surfaces are compressed against the interstitial member so that a portion of the first and/or second surface protrudes into an aperture of the interstitial member. In block 1009, the first and second surfaces are heated above their glass transition temperatures, resulting in a merging of the first and second surfaces and the portions of the first and/or second surface which extend through the apertures of the interstitial member to the other surface. These portions extending through the apertures become the filaments of the interface layer. The process concludes in block 1011 with removing the interstitial member. In some embodiments, removing the interstitial member can comprise burning the interstitial member, dissolving the interstitial member, or otherwise removing it. In some embodiments, after removing the interstitial member the space between the first surface and the second surface can be filled with a gas, a liquid, or a gel.

Figure 11:
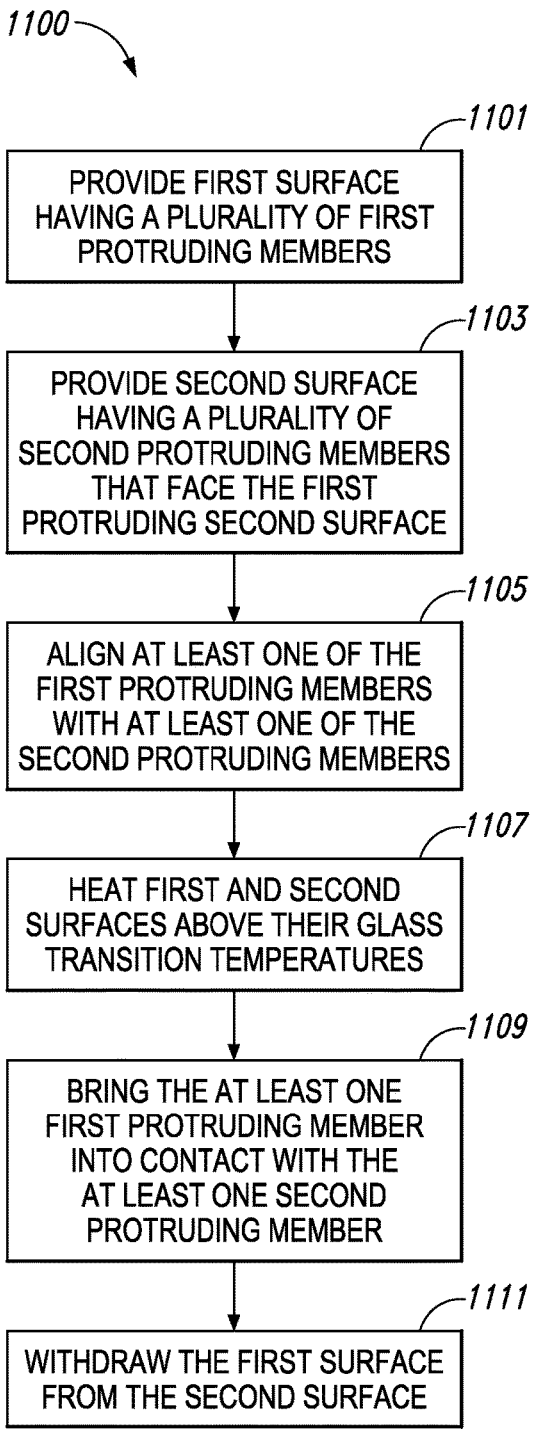
FIG. 11 is a flow diagram of another method of manufacturing an interface layer in accordance with embodiments of the present technology.

FIG. 11 is a flow diagram of another method of manufacturing an interface layer in accordance with embodiments of the present technology. The process 1100 begins in block 1101 by providing a first surface having a plurality of first protruding members. For example, the first surface can be a sheet having a plurality of raised portions, such as columns or bumps. Process 1100 continues in block 1103 by providing a second surface having a plurality of second protruding members that face the first protruding members of the first surface. In block 1105, at least one of the first protruding members is aligned with at least one of the second protruding members. In block 1107, the first and second surfaces are heated above their glass transition temperatures. The process 1100 continues in block 1109 by bringing the at least one first protruding member into contact with the at least one second protruding members. As the materials have been heated above their glass transition temperatures, the first protruding member and the second protruding member are joined by this contact. In block 1111, the first surface is withdrawn from the second surface. This can extend the length of the joined first and second protruding members, resulting in a filament extending between the first surface and the second surface. In some embodiments, the first and second protruding members can comprise a foam, a a polymer, an elastomer, or other suitable material. In some embodiments, the cross-sectional shape of the protruding members can be square, rectangular, triangular, elliptical, a regular polygon, or other shape. In some embodiments, the space between the first surface and the second surface can be filled with a gas, a liquid, or a gel.

Selected Embodiments of Protective Helmets Incorporating Force Sensors

Figure 12:
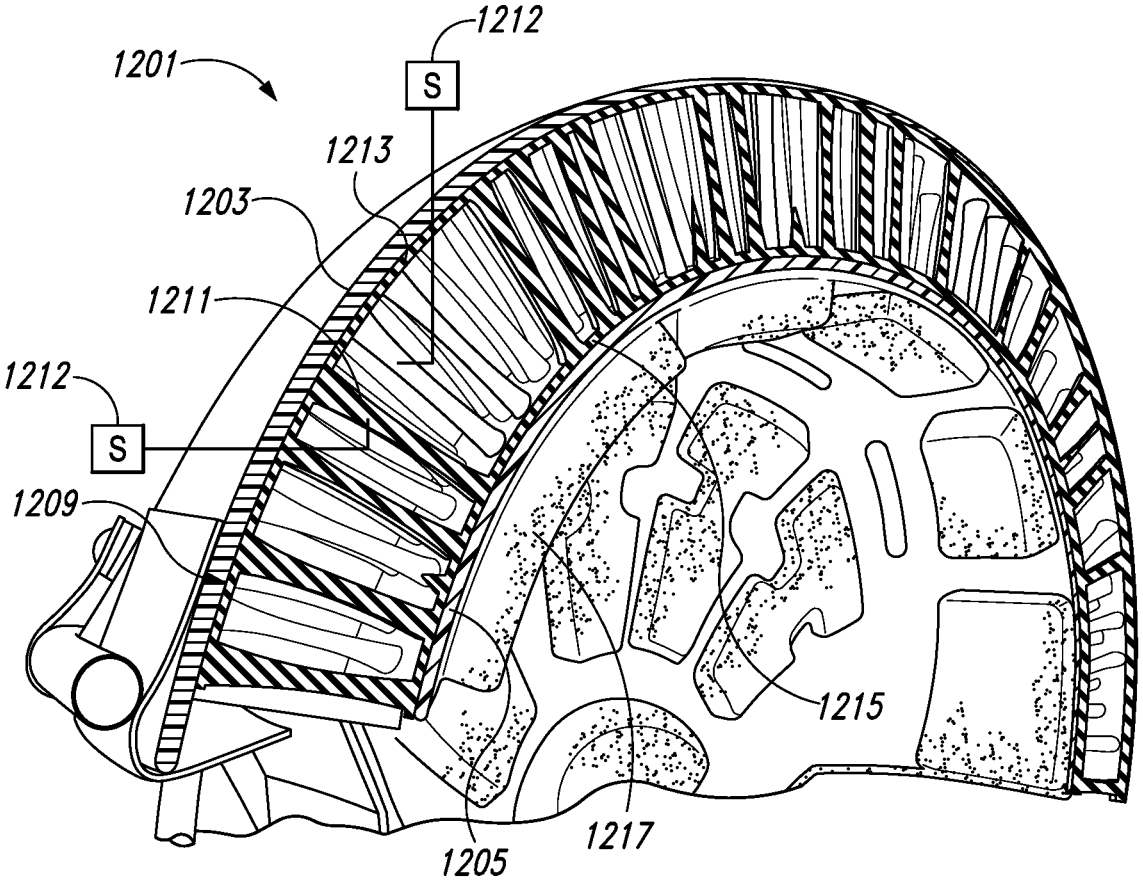
FIG. 12 is a perspective cross-sectional view of a protective helmet with filaments incorporating force sensors configured in accordance with embodiments of the present technology.

In some embodiments, the filaments in the interface layer of the helmet can also serve as force sensors or substrates for mounting force sensors. FIG. 12 is a perspective cross-sectional view of a protective helmet with filaments incorporating force sensors. The helmet 1201 comprises an outer layer 1203, an inner layer 1205, and an interface layer 1209 disposed between the outer layer 1203 and the inner layer 1205. The interface layer 1209 comprises a plurality of filaments 1211 that span or substantially span the space between the inner layer 1205 and the outer layer 1203. Force sensors 1212 (shown schematically) are coupled to the filaments 1211. In some embodiments, a wire or film could be embedded in, or on, each filament 1211. In some embodiments, the sensors 1212 can be sized and configured to produce a signal indicative of strain or deformation along the longitudinal axes of the filaments. These sensors 1212 can be configured to detect strain and or deformation of individual filaments 1211. The strain or deformation of the filament 1211 and sensor may then be related back to force using the known mechanical properties of the filaments 1211 and helmet 1201 structure. In some embodiments, the filament may be used directly as the sensor by providing the filament with electrical properties. For example, the filaments 1211 may have doped particles embedded to provide conductivity or piezoresistive properties. Deformation will then result in a change in electrical properties (e.g., resistance), allowing for electrical measurement of force. In some embodiments, the filaments 1211 can be made piezoelectric, allowing the filaments to generate electrical potential or current when deformed. In some embodiments, a sensor can comprise an optical waveguide with a first end and a second end, a light source incident upon one end of the optical waveguide, and a photodetector adjacent to the opposite end of the optical waveguide configured to receive light transmitted through the optical waveguide. In some embodiments, the waveguide can be a Bragg diffraction grating. In some embodiments, the Bragg diffraction gratings in each of the plurality of sensors can have unique periodicities.

The plurality of sensors can be logically coupled to a computing device and/or a data storage device capable of storing strain and deformation signals received from the plurality of sensors. In some embodiments, a wireless communication device can be coupled to the data storage device and configured to wirelessly transmit data stored on the data storage device to a second computing device. For example, in some embodiments the data storage device and wireless communication device can be embedded within the helmet, and can transmit the stored data to an external computing device. In some embodiments, the data storage device can include stored therein computer-readable program instructions that, upon execution by the computing device, cause the computing device to determine the magnitude and direction of a force incident upon the helmet based on the strain or deformation signals generated from the plurality of sensors. In some embodiments, the computing device can be configured to determine the acceleration of the wearer's head caused by the incident force. In some embodiments, the computing device can provide a signal indicating when the helmet has received incident forces over a defined threshold.

By embedding sensors in individual filaments, a plurality of sensors can be integrated into the helmet structure and provide single filament resolution of force transmission. Data from the sensors can be used to quantify hit number, magnitude, and location, to correlate hit magnitude with location and acceleration, to determine the likelihood of traumatic brain injury. The data may also be used to evaluate the current condition of the helmet and possible need for refurbishment or replacement. The data from individual players can be used to tune the material characteristics of the helmet for an individual's style of play and or position. For example in football, centers may tend to receive hits top center while wide receivers may tend to receive hits tangentially on the rear comer. This impact fitting process is unique from the helmet functionality and comfort fitting.

Examples

1. A helmet, comprising:
an inner layer;
an outer layer spaced apart from the inner layer to define a space;
an interface layer disposed in the space between the inner layer and the outer layer, wherein the interface layer comprises a plurality of filaments, the individual filaments comprising a first end proximal to the inner layer and a second end proximal to the outer layer, wherein the filaments are configured to deform non-linearly in response to an external incident force on the helmet.

2. The helmet of example 1 wherein the outer layer moves laterally relative to the inner layer in response to an external oblique force on the helmet.

3. The helmet of any one example 1 or example 2 wherein the filaments are configured to buckle in response to axial compression.

4. The helmet of any one of examples 1-3 wherein the individual filaments have an aspect ratio of between 3:1 and 1,000:1.

5. The helmet of any one of examples 1-4 wherein the filaments comprise a material selected from the group consisting of: a foam, an elastomer, a polymer, and any combination thereof.

6. The helmet of any one of examples 1-4 wherein the filaments are composed of a shape memory material.

7. The helmet of any one of examples 1-6 wherein the filaments comprise a self-healing material.

8. The helmet of any one of examples 1-7 wherein the filaments exhibit different shear characteristics in different directions.

9. The helmet of any one of examples 1-8 wherein at least a portion of the filaments have a non-circular cross-sectional shape.

10. The helmet of any one of examples 1-8 wherein the filaments have a cross-sectional shape selected from one of the following: circular, hexagonal, triangular, square, and rectangular.

11. The helmet of any one of examples 1-10 wherein a density of the filaments is higher in some portions of the interface layer than in other portions of the interface layer.

12. The helmet of any one of examples 1-11 wherein a thickness of each filaments varies along a length of the filament.

13. The helmet of any one of examples 1-12 wherein the inner layer and/or outer layer further comprise a plurality of sockets, and wherein:
the filaments further comprise a rotating member attached to at least one of the first end and the second end, the rotating member being configured to rotatably fit within one of the plurality of sockets.

14. The helmet of any one of examples 1-13 wherein at least a portion of the filaments are attached to the inner layer.

15. The helmet of any one of examples 1-14 wherein at least a portion of the filaments are attached to the outer layer.

16. The helmet of any one of examples 1-15 wherein each filament extends along a longitudinal axis, and wherein the longitudinal axes of the filaments are substantially perpendicular to a surface of at least one of the inner layer and the outer layer.

17. The helmet of any one of examples 1-16 wherein the outer layer comprises a plurality of segments, wherein at least one of the segments is configured to move relative to the other segments upon receiving an external incident force.

18. The helmet of example 17 wherein the second ends of the filaments are attached to one of the plurality of segments.

19. The helmet of example 17, further comprising resilient spacing members which flexibly couples the plurality of segments to one another.

20. The helmet of any one of examples 1-19 wherein the outer layer comprises an elastically deformable material.

21. The helmet of any one of examples 1-20 wherein the outer layer comprises a plurality of deformable beams, each having two ends and a longitudinal axis, wherein the ends of each of the plurality of deformable beams are flexibly connected to at least one other deformable beam, and wherein the longitudinal axis is parallel to the surface of the outer layer.

22. The helmet of example 21 wherein the ends of each of the deformable beams are flexibly connected to at least one other deformable beam and at least one of the filaments.

23. The helmet of any one of examples 1-22 wherein the inner layer comprises a shell configured to substantially surround the head of a wearer.

24. The helmet of any one of examples 1-23 wherein the inner layer comprises a material having a rigidity at least five times more rigid than the outer layer.

25. The helmet of any one of examples 1-24 wherein the inner layer comprises padding configured to substantially conform to the contours of a head.

26. The helmet of any one of examples 1-25 wherein at least one of the filaments is hollow.

27. The helmet of any one of examples 1-26 wherein at least one of the filaments is conical.

28. The helmet of any one of examples 1-27 wherein a longitudinal axis of a first filament of the plurality of filaments is not perpendicular to either the inner layer or the outer layer.

29. The helmet of example 28 wherein a longitudinal axis of a second filament of the plurality of filaments is not parallel to the longitudinal axis of the first filament.

30. The helmet of example 29 wherein an angle of the longitudinal axis of the first filament relative to at least one of the inner layer and the outer layer is supplementary to an angle of the longitudinal axis of the second filament relative to at least one of the inner layer and the outer layer.

31. The helmet of example 30 wherein the first filament is connected to the second filament at an intersection point.

32. A helmet comprising:

an inner layer;

an outer layer spaced apart from the inner layer to define a space; and an interface layer disposed in the space between the inner layer and the outer layer, wherein the interface layer comprises:

a first plurality of filaments, the individual first filaments comprising a first end proximal to the inner layer and a second end proximal to the outer layer;

and a second plurality of filaments, the second individual filaments comprising a first end proximal to the inner layer and a second end proximal to the outer layer;

wherein the first and second filaments are configured to deform non-linearly in response to an incident force, wherein a height of the first filaments substantially spans the space between the inner layer and the outer layer, and wherein a height of the second filaments does not substantially span the space between the inner layer and the outer layer.

33. The helmet of example 32 wherein the first ends of the second filaments are attached to the inner layer.

34. The helmet of example 32 or example 33 wherein the second ends of the second filaments are attached to the outer layer.

35. The helmet of any one of examples 32-34 wherein the second filaments have a lower aspect ratio than the first filaments.

36. The helmet of any one of examples 32-35 wherein the second filaments are more rigid than the first filaments.

37. A helmet comprising:

an inner layer;

an outer layer spaced apart from the inner layer to define a space, wherein the space comprises a material selected from the group consisting of a gas, a liquid, a gel, a foam, a polymeric material, and any combination thereof; and an interface layer disposed in the space between the inner layer and the outer layer, the interface layer comprising a plurality of filaments, each individual filament comprising a first end proximal to the inner layer and a second end proximal to the outer layer, wherein the filaments are configured to deform non-linearly in response to an incident external force.

38. The helmet of example 37 wherein the liquid comprises a shear thinning liquid.

39. The helmet of example 37 wherein the liquid comprises a shear thickening liquid.

40. The helmet of example 37 wherein the liquid comprises a shear thinning gel.

41. The helmet of example 37 wherein the liquid comprises a shear thickening gel.

42. A method of making an interface layer comprising at least one filament disposed between a first surface and a second surface, the method comprising:

providing a first surface comprising a plurality of first protruding elements protruding from the first surface;

providing a second surface comprising a plurality of second protruding elements protruding from the second surface, the second surface disposed opposite the first surface such at least one of the first protruding elements is aligned with at least one of the second protruding elements;

heating the first surface and second surface above their glass transition temperatures;

bringing the at least one first protruding element in contact with the at least one second protruding element; and withdrawing the first surface from the second surface, thereby providing at least one filament disposed between the first surface and the second surface.

43. The method of example 42 wherein the first protruding elements and second protruding elements comprise a foam.

44. The method of example 42 wherein the plurality of first protruding elements and the plurality of second protruding elements comprise a polymer.

45. The method of any one of examples 42-44 wherein the first protruding elements and the second protruding elements comprise a cross-sectional shape selected from the group consisting of: a square, a rectangle, a triangle, and an ellipse.

46. The method of any one of examples 42-45 wherein the first protruding elements and the second protruding elements comprise a cross-sectional shape of a regular polygon.

47. The method of any one of examples 42-46, further comprising filling a space between the first surface and the second surface with a gas, a liquid, or a gel.

48. A method of making an interface layer comprising at least one filament disposed between a first surface and a second surface, the method comprising:

providing a first surface;

providing a second opposite the first surface;

providing an interstitial member, disposed between the first surface and the second surface, comprising a plurality of apertures;

compressing the first surface and the second surface against the interstitial member so that a portion of the first surface and/or a portion of the second surface protrudes into the plurality of apertures;

heating the first surface and the second surface above their glass transition temperatures; and removing the interstitial member, thereby providing at least one filament disposed between the first surface and the second surface.

49. The method of example 48 further comprising withdrawing the first surface from the second surface.

50. The method of example 48 or example 49 wherein removing the interstitial member comprises burning the interface layer.

51. The method of example 48 or example 49 wherein removing the interstitial member comprises dissolving the interface layer.

52. The method of any one of examples 48-51 wherein the filament comprises a foam.

53. The method of any one of examples 48-52 wherein the filament comprises a polymer.

54. The method of any one of examples 48-53 wherein the apertures in the interstitial member are configured in a shape selected from the group consisting of: a square, a rectangle, a triangle, and an ellipse.

55. The method of any one of examples 48-54 wherein the apertures in the interstitial member are configured in the shape of a regular polygon 56. The method of any one of examples 48-55, further comprising filling the space between the first surface and the second surface with a gas, a liquid, or a gel.

57. A helmet comprising:

an inner layer;

an outer layer configured to provide a space between the inner layer and the outer layer;

an interface layer disposed in the space between the inner layer and the outer layer, the interface layer comprising a plurality of filaments, each individual filament comprising a first end proximal to the inner layer and a second end proximal to the outer layer; and a plurality of sensors coupled to at least a subset of the filaments, wherein the filaments are configured to deform non-linearly in response to an external incident force.

58. The helmet of example 57 wherein the sensors are sized and configured to produce a signal indicative of strain or deformation of the filaments.

59. The helmet of any one of examples 57-58 wherein the sensors comprise a wire or film.

60. The helmet of any one of examples 57-58 wherein the sensors comprise conductive polymer filaments.

61. The helmet of any one of examples 57-58 wherein the sensors comprise a plurality of doped particles.

62. The helmet of any one of examples 57-58 wherein the sensors comprise piezoelectric sensors.

63. The helmet of any one of examples 57-58 wherein the sensors comprise an optical waveguide with a first end and a second end, a light source incident upon one end of the optical waveguide, and a photodetector adjacent to the opposite end of the optical waveguide configured to receive light transmitted through the optical waveguide.

64. The helmet of example 63 wherein the optical waveguide comprises a Bragg diffraction grating.

65. The helmet of example 64 wherein the Bragg diffraction gratings in each of the sensors has a unique periodicity.

66. The helmet of any one of examples 57-65, further comprising:

a computing device logically coupled to the sensors; and a data storage device, capable of storing strain and deformation signals from the plurality of sensors.

67. The helmet of example 66, further comprising a wireless communication device configured to wirelessly transmit data stored on the data storage device to a second computing device.

68. The helmet of example 66, the data storage device having stored therein computer-readable program instructions that, upon execution by the computing device, cause the computing device to perform functions comprising:

determining a magnitude and a direction of a force incident upon the helmet based upon the strain or deformation signals generated from the sensors.

69. The helmet of example 68 wherein the functions further comprise determining an acceleration of a head of a wearer caused by the incident force.

70. The helmet of example 66, further comprising an indicator that provides a signal indicating when the helmet has received incident forces over a defined threshold.

CONCLUSION

The above detailed descriptions of embodiments of the technology are not intended to be exhaustive or to limit the technology to the precise form disclosed above. Although specific embodiments of, and examples for, the technology are described above for illustrative purposes, various equivalent modifications are possible within the scope of the technology, as those skilled in the relevant art will recognize. For example, while steps are presented in a given order, alternative embodiments may perform steps in a different order. The various embodiments described herein may also be combined to provide further embodiments. Various modifications can be made without deviating from the spirit and scope of the disclosure. For example, the interface layer can include filaments having any combination of the features described above. Additionally, the features of any particular embodiment described above can be combined with the features of any of the other embodiments disclosed herein.

From the foregoing, it will be appreciated that specific embodiments of the invention have been described herein for purposes of illustration, but well-known structures and functions have not been shown or described in detail to avoid unnecessarily obscuring the description of the embodiments of the technology. Where the context permits, singular or plural terms may also include the plural or singular term, respectively.

Moreover, unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. Additionally, the term "comprising" is used throughout to mean including at least the recited feature(s) such that any greater number of the same feature and/or additional types of other features are not precluded. It will also be appreciated that specific embodiments have been described herein for purposes of illustration, but that various modifications may be made without deviating from the technology. Further, while advantages associated with certain embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein.

We claim:

1. A helmet, comprising:

an inner layer, the inner layer having an outer surface;

an outer layer having an inner surface, the inner surface spaced apart from the inner layer outer surface; and an interface layer disposed between the inner layer outer surface and the inner surface of the outer layer, the interface layer comprises a plurality of elongated filaments having an aspect ratio between 3:1 and 1,000:1, at least two of the plurality of elongated filaments having different aspect ratios, the plurality of elongated filaments extend between the inner layer outer surface and the outer layer inner surface, the plurality of elongated filaments including a spacing between the plurality of elongated filaments, the spacing is filled with a gas, the interface layer further including a plurality of segmented tiles, each of the plurality of segmented tiles attached to a subset of the plurality of elongated filaments;

wherein the plurality of elongated filaments are configured to buckle in response to an external incident force on the helmet.

2. The helmet of claim 1 wherein the outer layer moves laterally relative to the inner layer in response to an external oblique force on the helmet.

3. The helmet of claim 1 wherein the buckling comprises a lateral deflection.

4. The helmet of claim 1 wherein the plurality of elongated filaments comprise a material selected from the group consisting of: a foam, an elastomer, a polymer, and any combination thereof.

5. The helmet of claim 1 wherein the plurality of elongated filaments are composed of a shape memory material.

6. The helmet of claim 1 wherein the plurality of elongated filaments comprise a self-healing material.

7. The helmet of claim 1 wherein the plurality of elongated filaments exhibit different shear characteristics in different directions.

8. The helmet of claim 1 wherein at least a portion of the plurality of elongated filaments have a non-circular cross-sectional shape.

9. The helmet of claim 1 wherein the plurality of elongated filaments have a cross-sectional shape selected from one of the following: circular, hexagonal, triangular, square, and rectangular.

10. The helmet of claim 1 wherein a density of the plurality of elongated filaments is higher in some portions of the interface layer than in other portions of the interface layer.

11. The helmet of claim 1 wherein a thickness of each of the plurality of elongated filaments varies along a length of the filament.

12. The helmet of claim 1 wherein at least a portion of the plurality of elongated filaments are attached to the inner layer.

13. The helmet of claim 1 wherein at least a portion of the plurality of elongated filaments are attached to the outer layer.

14. The helmet of claim 1 wherein each of the plurality of elongated filaments extends along a longitudinal axis, and wherein the longitudinal axes of the elongated filaments are perpendicular to a surface of at least one of the inner layer and the outer layer.

15. The helmet of claim 1 wherein the outer layer comprises an elastically deformable material.

16. The helmet of claim 1 wherein the inner layer comprises a material having a rigidity at least five times more rigid than the outer layer.

17. The helmet of claim 1 wherein the inner layer comprises padding configured to substantially conform to the contours of a head.

18. The helmet of claim 1 wherein at least one of the plurality of elongated filaments is hollow.

19. The helmet of claim 1 wherein at least one of the plurality of elongated filaments is conical.

20. The helmet of claim 1 wherein a longitudinal axis of a first filament of the plurality of elongated filaments is not perpendicular to either the inner layer or the outer layer.

21. The helmet of claim 20 wherein a longitudinal axis of a second filament of the plurality of elongated filaments is not parallel to the longitudinal axis of the first filament.

22. The helmet of claim 21 wherein an angle of the longitudinal axis of the first filament relative to at least one of the inner layer and the outer layer is supplementary to an angle of the longitudinal axis of the second filament relative to at least one of the inner layer and the outer layer.

23. The helmet of claim 22 wherein the first filament is connected to the second filament at an intersection point.

24. The helmet of claim 1, wherein the plurality of elongated filaments each have at least one end and the interface layer further comprises at least one sheet, the at least one end of the plurality of elongated filaments attached to the at least one sheet.

25. A helmet comprising:

an inner layer, the inner layer having an outer surface;

an outer layer, the outer layer having an inner surface, the inner surface of the outer layer spaced apart from the inner layer outer surface to define a space; and an interface layer disposed in the space between the inner layer outer surface and the inner surface of the outer layer, wherein the interface layer comprises:

a first plurality of elongated filaments having an aspect ratio between 3:1 and 1,000:1, each of the first plurality of elongated filaments comprising a first end proximal to the inner layer outer surface and a second end proximal to the outer layer inner surface; and a second plurality of elongated filaments having an aspect ratio between 3:1 and 1,000:1, each of the second plurality of elongated filaments comprising a first end proximal to the inner layer or a second end proximal to the outer layer inner surface, and a plurality of segmented tiles, each of the plurality of segmented tiles attached to a subset of the first and second plurality of elongated filaments;

wherein the first and second plurality of elongated filaments are configured to deform non-linearly in response to an incident force, a height of the first plurality of elongated filaments extends between the inner layer outer surface and the outer layer inner surface, a height of the second plurality of elongated filaments extends between the inner layer outer surface and the outer layer inner surface; and the height of the first plurality of elongated filaments is greater than the height of the second plurality of elongated filaments.

26. The helmet of claim 25 wherein the first ends of each of the second plurality of elongated filaments are attached to the inner layer.

27. The helmet of claim 25 wherein the second ends of each of the second plurality of elongated filaments are attached to the outer layer.

28. The helmet of claim 25 wherein the second plurality of elongated filaments have a lower aspect ratio than the first plurality of elongated filaments.

29. The helmet of claim 25 wherein the second plurality of elongated filaments are more rigid than the first plurality of elongated filaments.

30. The helmet of claim 25, wherein the plurality of segmented tiles includes a tile spacing between each of the segmented tiles, the tile spacing being filled with a gas.

* * * * *